US008627589B2

(12) United States Patent
Pitcher et al.

(10) Patent No.: US 8,627,589 B2
(45) Date of Patent: Jan. 14, 2014

(54) FRAME ASSEMBLY ARRANGEMENT

(75) Inventors: David E. Pitcher, Swampscott, MA (US); Thomas P. Burrous, Haverhill, MA (US); Rebecca C. Suciu, Lynn, MA (US); Alan Stenfors, Scituate, MA (US); Sidney Rose, Marblehead, MA (US)

(73) Assignee: Rose Displays Ltd., Salem, MA (US)

( * ) Notice: Subject to any disclaimer, the term of this patent is extended or adjusted under 35 U.S.C. 154(b) by 432 days.

(21) Appl. No.: 12/930,463

(22) Filed: Jan. 7, 2011

(65) Prior Publication Data

US 2012/0174449 A1 Jul. 12, 2012

(51) Int. Cl.
*A47G 1/10* (2006.01)

(52) U.S. Cl.
USPC ..... 40/785; 40/758

(58) Field of Classification Search
USPC ..... 40/782, 785, 758
See application file for complete search history.

(56) References Cited

U.S. PATENT DOCUMENTS

| | | | | | |
|---|---|---|---|---|---|
| 3,613,279 | A | * | 10/1971 | Belfor | 40/782 |
| 3,783,543 | A | * | 1/1974 | Hemgren | 40/766 |
| 4,568,055 | A | * | 2/1986 | Klitzky | 248/496 |
| 4,630,386 | A | * | 12/1986 | Wilson | 40/734 |
| 4,964,231 | A | * | 10/1990 | De Maat et al. | 40/735 |
| 5,367,803 | A | * | 11/1994 | Albin | 40/759 |
| 5,479,733 | A | * | 1/1996 | Kusina | 40/785 |

* cited by examiner

*Primary Examiner* — Gary Hoge
(74) *Attorney, Agent, or Firm* — Don Halgren

(57) ABSTRACT

A frame assembly for supporting and displaying a display panel comprising: at least one pair of elongated split rails supported in a joined, spaced apart, parallel relationship by a pair of first corner connectors that are permanently mated therewith, either a second pair of elongated split rails or a unitary rail and a pair of elongated unitary rails fixedly attached by sliding, barbed and threaded engagement to the preceding rails to form a four sided frame assembly.

19 Claims, 10 Drawing Sheets

FRAME ASSEMBLY ARRANGEMENT

BACKGROUND OF THE INVENTION

1. Field of the Invention

This invention relates to frame assemblies and more particularly to a construction for a pressed together and screwed together connection arrangement to permit the easy assembly of panel displays for commercial purposes.

2. Discussion of Prior Art

The commercial display industry is replete with panel holding systems for supporting signage in business establishments. There is a need however for frame assemblies which are easily assembled by business employees of those commercial establishments, which employees require minimal technical capabilities, which frame assemblies however, permit a wide variety of assembly configurations. Such frame assemblies also need to be sturdy so as to withstand occasional customer abuse or mistreatment and which frame assemblies may be shipped and/or stored in a minimal space or containment.

It is therefore an object of the present invention, to overcome the disadvantages of the prior art.

It is a further object of the present invention to provide a frame assembly which may be readily assembled by commercial staff with minimal training.

It is still yet a further object of the present invention, to provide a frame assembly in which portions thereof may be preassembled, in a configuration which minimizes the size of any shipping container needed, or minimizes the storage facility necessary therefor.

BRIEF SUMMARY OF THE INVENTION

The present invention comprises a frame assembly consisting of a plurality of unitary rails and split rails joined at their respective mitered ends by corner connectors. In a first preferred embodiment, the frame assembly comprises a quadrilateral arrangement. In this embodiment, one side of the frame assembly consists of a pair of elongated split rails joined together. The other three sides of the frame assembly are each comprised of an elongated unitary rail. A corner connector is permanently pressed into each end of a pair of opposed, parallel, split rails and into each end of the parallel unitary rail. Each corner connector is also, subsequently slid into an adjacent unitary rail and threadedly attached thereto, so as to form a four sided frame assembly.

Each elongated a unitary rail is of generally "U" shape in cross section, and consists of an outer bridge member connected to a first side member of generally "L" shape in cross-section and a second side member of generally "L" shape in cross section. The "L"-shaped portions of the first and second side members are the inner side of the unitary rails when assembled in the frame assembly. The "L"-shaped portions have an inner flange which are opposed to one another, and define a panel-receiving slot therebetween. The unitary rail also has an inner bridge member extending thereacross at a mid-point between the first and second sides thereof. The inner bridge member has a generally "U" shaped bolt-receiving boss upstanding thereon. An elongated channel extends between the outer bridge member and the inner bridge member, so as to define an elongated leg-receiving-channel, further explained hereinbelow. The inner bridge member has an elongated surface on each side of the generally U-shaped bolt receiving boss, to function as a "barb-engaging" surface therealong, further explained hereinbelow.

Each elongated split rail assembly comprises a first and a second split rail which are identical and face one another to form a symmetrical assembly. Each split rail member is generally of "E" shape in cross section. Each split rail member has an outer side-flange and an inner side-flange connected by a sidewall. Each split rail member has a generally "L"-shaped mid-flange extending off the inner side of a mid-portion of the sidewall. The generally L-shaped mid-flange extending off of the mid-portion of the sidewall of each split rail member has a barb engaging surface thereon. The L-shaped mid-flange on a first split rail functions to provide a receiving channel which receives and engages and secures a first (or second) leg of the corner connectors so as to hold the respective first and second split rails parallel and spaced apart from one another in a sturdy construction thereof, when a second leg of the corner connector is inserted in the receiving channel of a second split rail thereadjacent.

An elongated swivel-support rail, for external support of a frame assembly, has certain features identical to the elongated unitary rail except that it does not have the extended legs which form a display panel receiving channel, and is adaptable to the outside of the unitary rails on a frame assembly so as to provide a swivel support therefor. The elongated swivel-support rail comprises outer bridge member and a first sidewall and a second sidewall connected by an inner bridge member, with a U-shaped bolt-receiving boss extending inwardly thereon.

A further internal structural support member for a frame assembly embodiment, comprises an elongated central cross member. The elongated central cross member has a first sidewall having an "L" shaped flange at its upper end and a "L" shaped flange at its lower end, connected by a bolt receiving bridge member, to a mirror-image second sidewall. The bolt receiving bridge member has an elongated slot exposed there through so as to permit a threaded member to be secured within that elongated slot between opposed rail members of the frame assembly. On either side of the threaded connector receiving channel, the elongated central cross member also has a pair of side channels. These serve to receive a pin which may be used to prevent rotation when one end of the pin is engaged in a drilled hole in the inner flange of an abutting cross member, split rail or unitary rail.

The corner connector comprises an "L"-shaped member having a hub from which a first leg and a second leg extend in a parallel, bifurcated manner. The corner connector also has a third leg extending from the hub in a manner which is perpendicular to the first and second legs. A bolt hole extends through the hub and parallel to the third leg. A cleat extends off of an outer side of the third leg, between a pair of spaced apart flanges thereon. The first and the second leg have an inner side on which a plurality of gripping barbs are arranged. In a preferred embodiment of the corner connector, the first and second legs extending from the hub, are longer than the third leg extending from the hub.

In one preferred embodiment of the construction of the frame assembly of the present invention, a corner connector may have its first and second legs, that is its longer legs, inserted into each end of a pair of opposed split rails, wherein each leg is inserted within a leg receiving channel of a respective elongated split rail. The barbs on the underside of the first and second legs of the corner connector engage the barb engaging surface on the inner L-shaped member respectively, on each elongated split rail. The first leg and the second leg on each of a pair of corner connectors inserted into the respective open ends of the elongated split rail, holds the elongated split rails in a spaced apart configuration, so as to thereby define a display panel receiving slot therebetween.

An elongated unitary rail may similarly receive a pair of the first and second legs inserted at each end thereof within their respective leg-receiving channels. Each leg receiving channel on the elongated unitary rail as noted hereinabove, has a barb engaging surface adjacent its mid-located U-shaped bolt receiving boss. The barbs on the underside of the first and second legs in the bufurcated leg arrangement on the corner connector engage the barb engaging surface in the leg receiving channels, so as to snugly support and lockingly secure that corner connector received therein. It has to be noted herein that the length of the third leg extends from the hub no further than the plane of the first and the second side flanges of the split rails and of the unitary rails in which the longer first and second legs are inserted. This permits a pre-assembly of a set of corner connectors into a set of elongated split rails and a preassembly of an elongated unitary rail with minimum space requirements, to facilitate shipment to and assembly at a commercial location while minimizing damage potential to adjacently packaged rails.

Once a set of corner connectors has been inserted into their respective ends of an elongated split rail and an elongated unitary rail, a further pair of unitary rails may now receive the third leg of each corner connector which extends from the respective ends of the pre-assembled split rail assembly and the elongated unitary rail, so as to provide the third and fourth sides of a frame assembly.

A threaded member such as a screw or a bolt may be inserted through the slot in the outer side portions of the split rail and through the bolt hole at the hub of the corner connectors and into the U-shaped boss to secure the split rail assembly to a pair of side unitary rails. A similar arrangement may be constructed with the remaining unitary rail at the other end of the now-attached side unitary rails by insertion of a bolt through a pre-drilled bolt hole at the respective ends of the unitary rail and through the bolt hole in each corner connector and into a U-shaped bolt receiving boss on the inner bridge member of the respective unitary rail for completion of a four sided frame assembly.

A further aspect of the present invention includes an "H"-shaped sliding carriage having a first leg and a second leg in a parallel, spaced apart configuration, connected by a bridge member extending between a mid-portion thereof. The bridge member includes a mid-portion with a bolt hole therethrough. The sliding carriage may be inserted within the leg receiving channels of a pair of split rails before the corner connectors are inserted respectively therein. The sliding carriage permits an elongated central cross member, identified hereinabove, to be supported between a pair of parallel rails, such as an elongated unitary rail and an elongated pair of split rails. The bolt hole through the bridge member of the sliding carriage is arranged to receive an attachment bolt which extends therethrough, which attachment bolt would penetrate and be secured to the elongated slot in each respective end of the elongated central cross member to permit its' extending between a pair of parallel rails. The elongated central cross member also has a pair of side channels to either side of the receiving channel. These serve to receive a pin which may be used to prevent rotation when one end of the pin is engaged in a drilled hole in the inner flange of an abutting cross member, split rail or unitary rail. The elongated central cross member would function so as to subdivide a frame assembly into smaller panel-supporting members. Each elongated central cross member also has a pair of elongated panel-receiving slots at respective sides thereof so as to receive and support a display panel therewithin, in conjunction with the receiving slots on the inner side of a unitary rail or on the inner side of a pair of assembled the elongated split rails.

The invention thus comprises a frame assembly for supporting and displaying a display panel comprising: at least one pair of elongated split rails supported in a joined, spaced apart, parallel relationship, by a pair of first corner connectors that are permanently pressed in either a second pair of elongated split rails or a unitary rail with a second set of corner connectors permanently pressed therein, and a pair of elongated unitary rails attached to the corner connectors connected by a screw or bolt to form a 4-sided frame assembly. Each elongated split rail preferably has a corner connector leg-engaging channel. Each elongated unitary rail preferably has a pair of parallel, spaced-apart corner connector leg-engaging channels. Each corner connector preferably is of "L"-shape. Each elongated unitary rail preferably has a generally "U"-shaped bolt receiving boss arranged between the spaced-apart corner connector leg-engaging channels. Each pair of joined, elongated split rails and each elongated unitary rail has an inwardly facing, panel-receiving slot therein. Each leg engaging channel of each elongated split rail preferably has a barb engaging surface thereon. The frame assembly preferably consists of one pair of joined split rails, and three elongated unitary rails, one of the elongated unitary rails, and the pair of joined split rails having a corner connector permanently pressed in place, and attached to the additional two unitary rails by sliding the corner connector into their leg engaging channels and screwing the rails together, to form a quadrilateral frame assembly. In an alternative embodiment, the frame assembly may also consist of two pairs of joined split rails and two unitary rails. The frame assembly may include one or more elongated central cross-members adjustably supported between any two rails or split rail pairs. If the elongated cross-member is supported between one or more split rail pairs, an "H" shaped sliding carriage may be arranged within the leg engaging channels of the parallel, joined split rails. An "H" shaped sliding carriage may be located in the split rail pair adjacent to the end of the elongated central cross member to support that cross member when it abuts against the parallel joined elongated split rails, or a hole may be drilled in an abutting unitary rail or central cross member to allow a screw or bolt to pass through. The "L"-shaped corner member preferably comprises a first and a second spaced apart parallel leg arrangement extending from a corner hub, and a third leg arranged on the hub in a 90° orientation from the first and second legs thereof. The "L"-shaped corner member may have a bolt hole extending through the corner hub thereof, so as to permit securement of the corner member to an elongated adjacent rail. The first and second spaced apart parallel leg arrangement may be longer than the third leg extending from the corner hub. The first and second parallel legs of the corner connector may have an arrangement of gripping the barbs on an inwardly directed surface thereof. The corner hub may have an "L" shaped cleat on the third leg thereof, to enable a support cable loop to be disposed therearound for supporting the frame assembly from an overhead support.

The invention also includes a method of supporting and displaying a display panel comprising: connecting at least one pair of elongated split rails supported in a joined, spaced apart, parallel relationship by a pair of first corner connectors; connecting a set of elongated unitary rails attached to one another by a second pair of corner connectors, the unitary rails also attached to at least one pair of split rails by the first corner connectors, so that at least one pair of joined, split rails and the set of elongated unitary rails form a four sided frame assembly, with an inwardly facing display panel-receiving slot arranged contiguously therearound, the inwardly facing panel-receiving slot arranged to slidingly receive a display panel from the receiving-slot arranged between at least one pair of joined split rails. The method may include: forming a pair of spaced apart first and second legs on a portion of the corner connector to engage independent leg receiving channels on each elongated split rail, and to hold those joined, split rails apart in a parallel spaced apart relationship; forming a third leg on a portion of the corner connector to slidingly engage a connector receiving channel in an adjacent elongated unitary rail; supporting the four sided frame assembly from an overhead support by a loop disposed around an L-shaped cleat extending from an outer side of the third leg on a first and on a second corner connector arranged at the respective ends of the uppermost joined pair of split rails.

The invention also may comprise a four sided frame assembly for supporting and displaying a display panel therewithin, the frame assembly comprising: a first elongated rail having a permanently fixed corner connector inserted into a corner-connector receiving-channel at each end thereof; a second elongated rail having a permanently fixed corner connector inserted into a corner-connector receiving-channel at each end thereof; and a pair of elongated side rails arranged parallel to each other and perpendicular to the first and second rails, the side rails having a corner connector receiving channel and a fastener receiving channel, to permit a securably reinforced construct of the four sided frame assembly. The corner connector in each end of the first elongated rail has a hub with a channel for the receipt of a fastener to extend therethrough and into the fastener receiving channel of an adjacent respective side rail. The fastener preferably comprises a threaded member. The first elongated rail preferably comprises a joined split rail arrangement. The corner connector arranged at each end of the elongated first rail preferably has a rail engaging surface with an arrangement of barbs thereon for secure engagement with a corner-connector receiving-channel. The corner connectors at each end of the first and the second rails may also be secured thereto by one of following: adhesive, elongated fasteners and metal deformation. The first rail may be a unitary rail. The unitary rail may have has a slot arranged through an outer bridge member thereof, to permit passage of a display panel therethrough and into the frame assembly. The fastener preferably extends in parallel alignment with the adjacent rail to which it is attached. Each corner connector preferably has a pair of split legs and a single leg which each extend from a common corner hub. The split legs of each corner connector are preferably longer than the single leg extending from the common corner hub to provide orientation cues for ease of assembly and eliminate unnecessary damage during partial pre-assembled shipping. The corner hub preferably has a support cleat thereon, to permit engagement with an overhead support member. The frame assembly may include at least one elongated central cross-member adjustably supported between two rails. A sliding carriage may be arranged within the corner connector receiving channel of the parallel, joined split rails.

The invention may also include a method of securely supporting and displaying a display panel within a four sided frame assembly, comprising one or more of the following the steps of: installing a corner connector permanently, into a corner-connector receiving-channel in each end of an elongated first rail; installing a corner connector permanently, into a corner-connector receiving-channel in each end of an elongated second rail; and assembling the first rail and the second rail with a pair of elongated side rails arranged parallel to each other and perpendicular to the first and second rails, the side rails having a corner connector receiving channel mating with the respective corner connectors in the first rail and the second rail, the side rails each also having a fastener receiving channel, to permit a fastener secured reinforced construct of the four sided frame assembly; installing a fastener through a fastener receiving channel in a hub of the corner connector in each end of the first elongated rail and into the fastener receiving channel of an adjacent respective side rail. The fastener preferably comprises a threaded member. The first elongated rail preferably comprises a joined split rail arrangement. The method may also include arranging barbs on a rail engaging surface of the corner connector arranged at each end of the elongated first rail for secure engagement of the corner-connector with the corner connector receiving-channel; and supporting the frame assembly from an overhead support by attachment of a support member to a cleat arranged on an outer side of the hub of the corner connectors received in the corner connector receiving channels in the elongated first rail.

BRIEF DESCRIPTION OF THE DRAWINGS

The objects and advantages of the present invention will become more apparent, when viewed in conjunction with the following drawings in which.

DETAILED DESCRIPTION OF THE PREFERRED EMBODIMENTS

Figure 1:
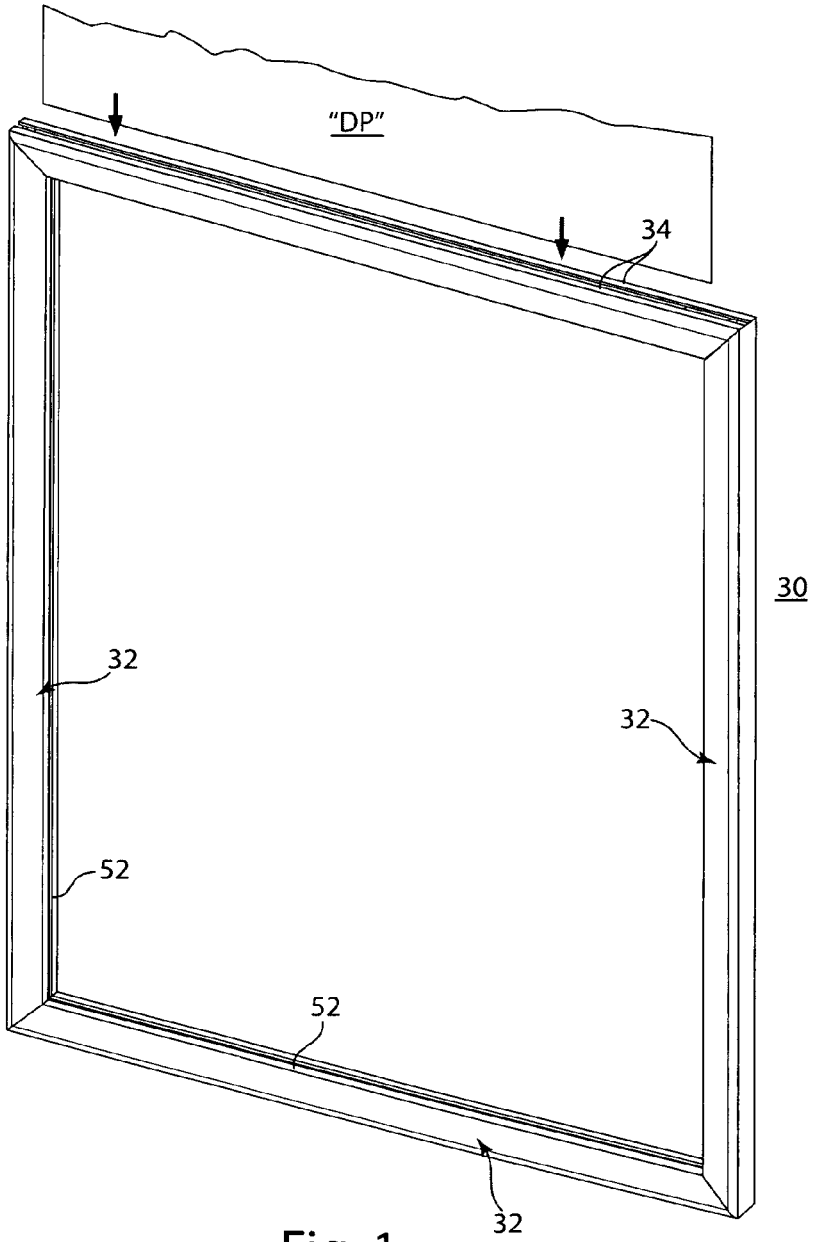
FIG. 1 is a perspective view of the frame assembly constructed according to the principles of the present invention.
Figure 2:
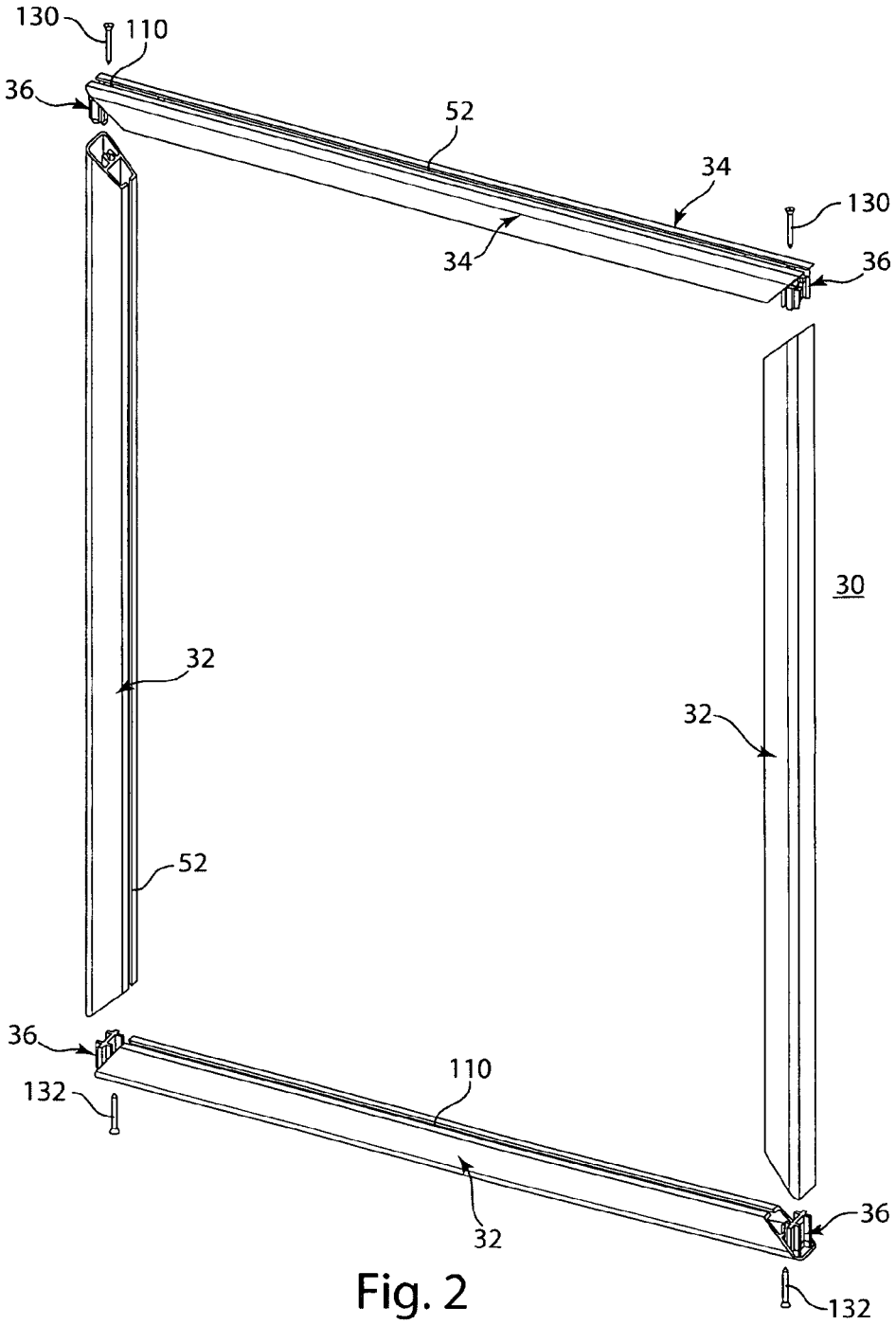
FIG. 2 is an exploded perspective view of the frame assembly shown in FIG. 1.

Referring now to the drawings in detail and particularly to FIG. 1, there is shown the present invention which comprises a frame assembly 30, for receipt of a display panel "DP". The frame assembly 30 consists of a plurality of unitary rails 32 and a pair of split rails 34 joined at their respective mitered ends by a corner connector 36, as represented in FIG. 2. In a first preferred embodiment, the frame assembly 30, as represented in FIGS. 1 and 2, comprises a quadrilateral arrangement. In this embodiment, one side of the frame assembly 30 consists of a pair of elongated split rails 34 joined together by a corner connector 36 at each end thereof, as represented in an exploded view in FIG. 9. The other three sides of the frame assembly 30 are each preferably comprised of an elongated unitary rail 32, as represented in FIGS. 1 and 2. A corner connector 36 is permanently pressed into each end of a pair of opposed, parallel, split rails 34, as may be seen in FIG. 9 and each end of the opposing unitary rail 32, as may be seen in FIG. 10. Each corner connector 36 may be subsequently slid into an adjacent unitary rail 32, and threadedly attached thereto, by a bolt or pin 132, as represented in FIG. 2, so as to form a four sided frame assembly 30 as represented in FIG. 1.

Figure 4:
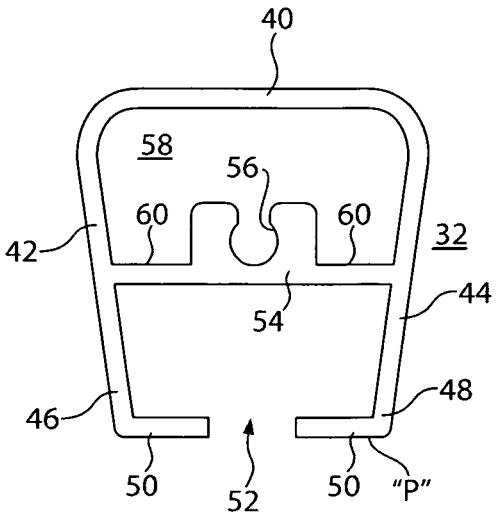
FIG. 4 is a cross-sectional view of elongated unitary rail.

Each elongated a unitary rail 32 is of generally "U" shape in cross section, as shown in FIG. 4, and consists of an outer bridge member 40 connected to a first side member 42 having an inner portion 46 of generally "L" shape in cross-section and a second side member 44 also having an inner portion 48 of generally "L" shape in cross section. The "L"-shaped portions 46 and 48 of the first and second side members 42 and 44 are the inner side of the unitary rails 32 when assembled in the frame assembly 30. The "L"-shaped portions 46 and 48 each have an inner flange 50 which are opposed to one another as represented in FIG. 4, and define a panel-receiving slot 52 therebetween, as may be seen in FIGS. 1, 2 and 4. The unitary rail 32 also has an inner bridge member 54 extending thereacross at a mid-point between the first and second sides 42 and 44 thereof. The inner bridge member 54 has a generally "U" shaped bolt-receiving boss 56 upstanding thereon. An elongated channel 58 extends between the outer bridge member 40 and the inner bridge member 54, so as to define an elongated leg-receiving-channel 58, further explained hereinbelow. The inner bridge member 54 has an elongated surface 60 on each side of the generally U-shaped bolt receiving boss 56, shown in FIG. 4, to function as a "barb-engaging" surface therealong, further explained hereinbelow.

Figure 3:
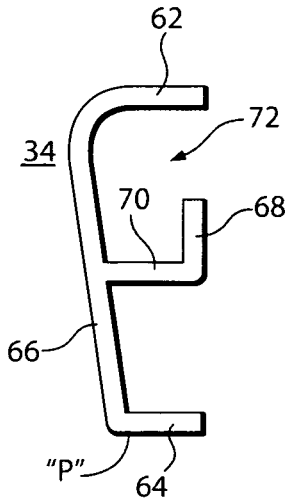
FIG. 3 is a cross-sectional view of a elongated split rail.
Figure 9:
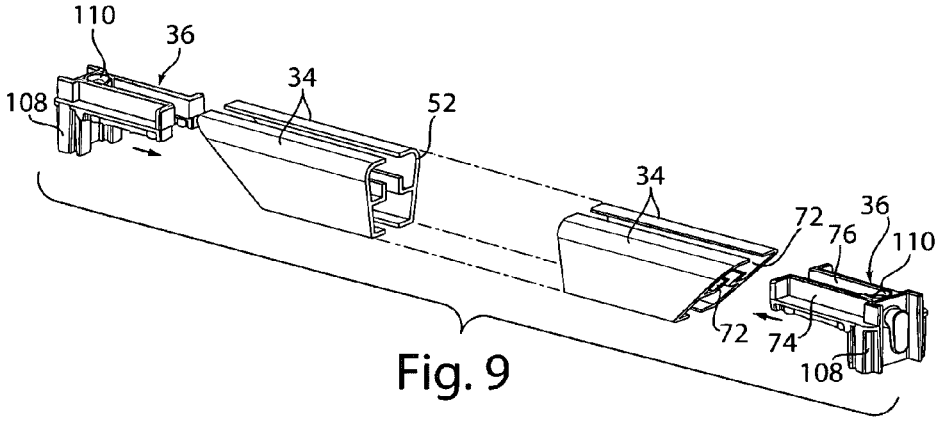
FIG. 9 is an exploded view of a pair of elongated split rails and their associated corner connectors in a preassembled configuration thereof.

Each elongated split rail assembly comprises a first and a second split rail 34, which are identical and face one another, to form a symmetrical assembly, as may be seen in FIG. 9. Each split rail member 34 is generally of "E" shape in cross section, as best represented in FIG. 3. Each split rail member 34 has an outer side-flange 62 and an inner side-flange 64 connected by a sidewall 66. Each split rail member 34 has a generally "L"-shaped mid-flange 68 extending off the inner side of a mid-portion of the sidewall 66, as shown in FIG. 3. The generally L-shaped mid-flange 68 extending off of the mid-portion of the sidewall 66 of each split rail member 34 has an elongated barb engaging surface 70 thereon. The L-shaped mid-flange 68 on a first split rail 34 functions to provide a receiving channel 72 which receives and engages and secures a first (or second) leg 74 and 76 of the corner connectors 36 so as to hold the respective first and second split rails 34 and 34 parallel and spaced apart from one another in a sturdy construction thereof, when a first and second leg 74 and 76 of the corner connector 36 is inserted in the receiving channel 72 of a mirror image second split rail 34 thereadjacent, as may be seen in FIG. 9.

Figure 6:
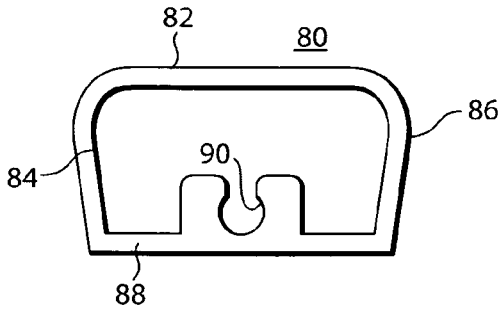
FIG. 6 is a cross-sectional view of an elongated swivel support rail.
Figure 17:
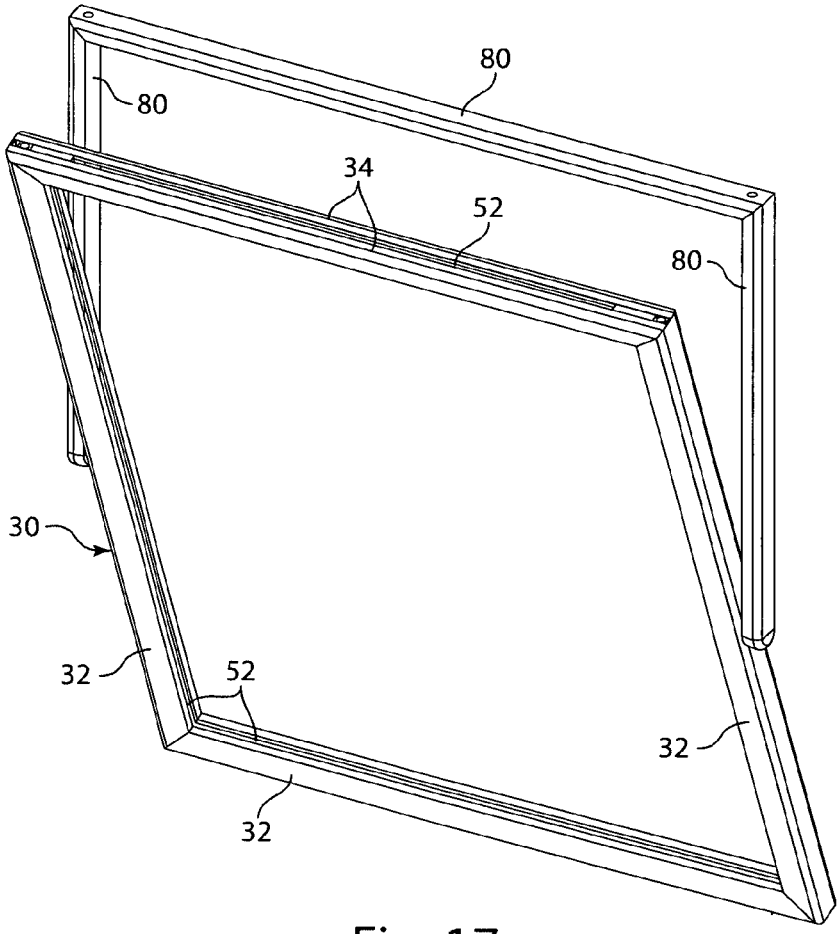
FIG. 17 is a perspective view of a frame assembly supported in a swivel support attached thereto.

An elongated swivel-support rail 80, for external support of a frame assembly 30, has certain features identical to the elongated unitary rail 32 (except that it does not have extended legs which form a display panel receiving channel), and is adaptable to the outside of the unitary rails 32 on a frame assembly 30 so as to provide a swivel support therefore, as represented in FIG. 17. The elongated swivel-support rail 80 comprises outer bridge member 82 and a first sidewall 84 and a second sidewall 86 while connected by an inner bridge member 88, with a U-shaped bolt-receiving boss 90 extending inwardly thereon, as represented in FIG. 6.

Figure 5:
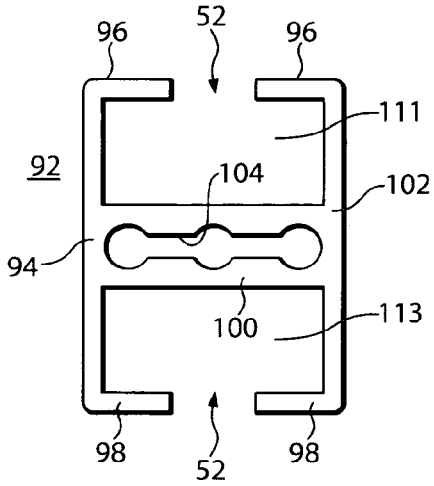
FIG. 5 is a cross-sectional view of an elongated central cross member.
Figure 16:
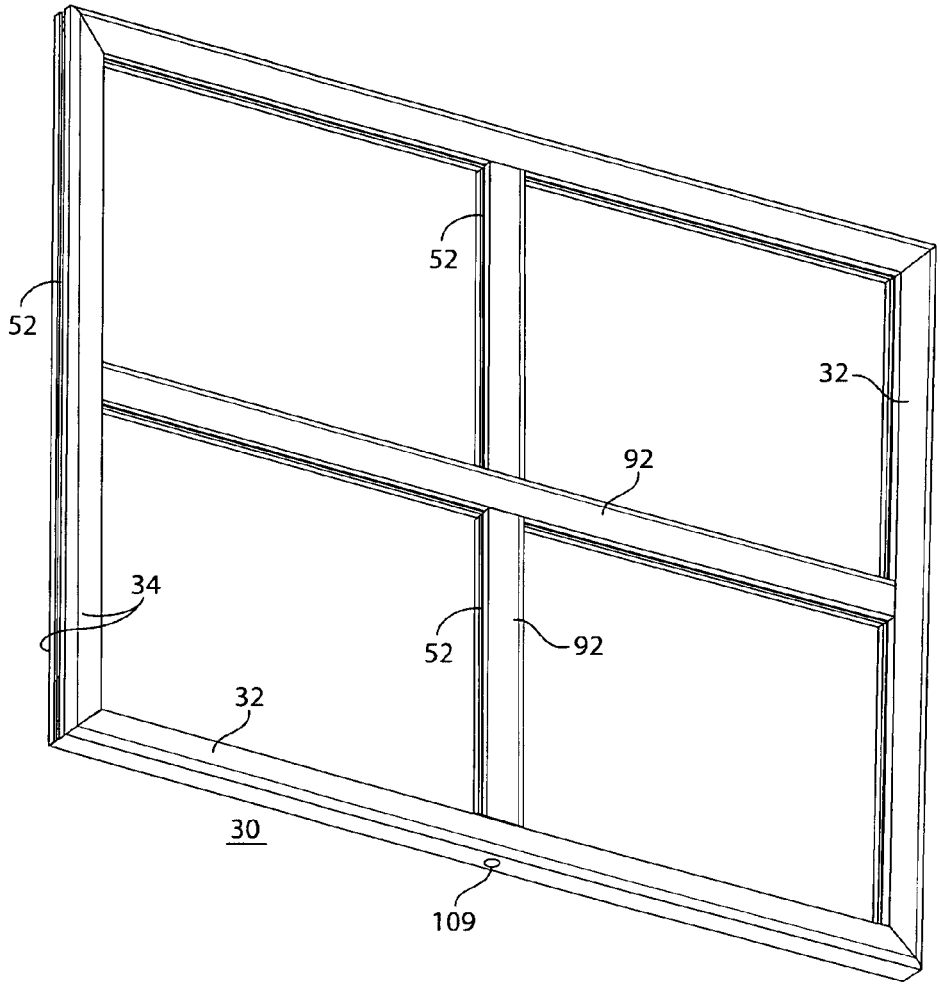
FIG. 16 is a perspective view of a frame assembly showing elongated central cross members arranged there within.

A further internal structural support member for a frame assembly embodiment, comprises an elongated central cross member 92, shown in cross section in FIG. 5, and in a frame assembly 30, shown in FIG. 16. The elongated central cross member 92 has a first sidewall 94 having an "L" shaped flange 96 at its upper side, and a "L" shaped flange 98 at its lower side, connected by a bolt receiving bridge member 100, to a mirror-image second sidewall 102, having an "L" shaped flange 96 at the upper side (end as shown in FIG. 5), and a "L" shaped flange 98 at its lower side (end as shown in FIG. 5). The bolt receiving bridge member 100 has an elongated slot 104 disposed therethrough so as to permit a threaded member 109, to be secured within that elongated slot 104 between opposed rail members of the frame assembly 30, as represented in FIG. 16. On either side of the elongated slot 104, the elongated central cross member also has a pair of side channels 111 and 113, as represented in FIG. 5. These serve to receive a pin, not shown for clarity, which pins may be used to prevent rotation when one end of the pin is engaged in a drilled hole in the inner flange of an abutting cross member 92, split rail 34 or unitary rail 32.

Figure 7:
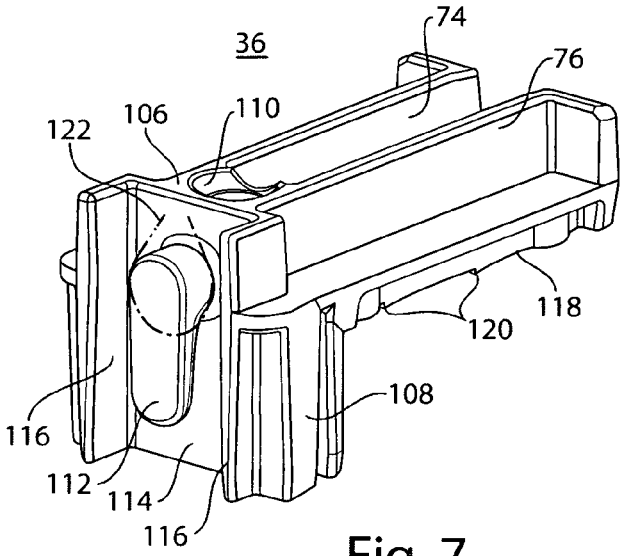
FIG. 7 is a perspective view of a corner connector.
Figure 8:
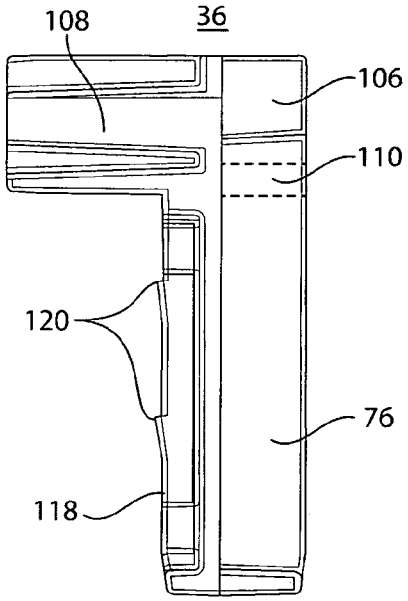
FIG. 8 is a side elevation view of the corner connector shown in FIG. 7.

The corner connector 36, best represented in FIGS. 7 and 8, comprises an "L"-shaped member having a hub 106 from which the first leg 74 and the second leg 76 extend in a parallel, bifurcated manner. The corner connector 36 also has a third leg 108 extending from the hub 106 in a manner which is perpendicular to the first and second legs 74 and 76. A bolt hole 110 extends through the hub 106 and extends parallel to the third leg 108. A cleat 112 extends off of an outer side 114 of the third leg 108, as shown in FIG. 7, between a pair of spaced apart flanges 116 thereon. The first and the second leg each have an inner side 118 on which a plurality of gripping barbs 120 are arranged. In a preferred embodiment of the corner connector, the first and second legs 74 and 76 extending from the hub 106, are longer than the third leg 108 also extending from the hub 106. A support wire 122, shown with dashed lines in FIG. 7, having a loop at its lower end, may encircle the cleat 112 and extend through the slot 52 between a pair of split rails 34 so as to support a frame assembly from an overhead support, not shown for clarity of figures.

In one preferred embodiment of the construction of the frame assembly of the present invention, a corner connector may have its first and second legs, that is, its longer legs 74 and 76, inserted into each end of a pair of opposed split rails 34, wherein each leg 74 and 76 is inserted within a respective leg receiving channel 72 of a respective elongated split rail 34, as represented in FIG. 9. The barbs 120 on the underside 118 of the first and second legs 74 and 76 of the corner connector 36 engage the barb engaging surface 70 on the inner L-shaped member 68, respectively, on each elongated split rail 34. The first leg and the second leg 74 and 76 on each of a pair of corner connectors 36 inserted into the respective open ends of the pair of elongated split rails 34, holds the elongated split rails 34 in a spaced apart configuration as represented in FIG. 9, so as to thereby define the display panel receiving slot 52 therebetween.

Figure 10:
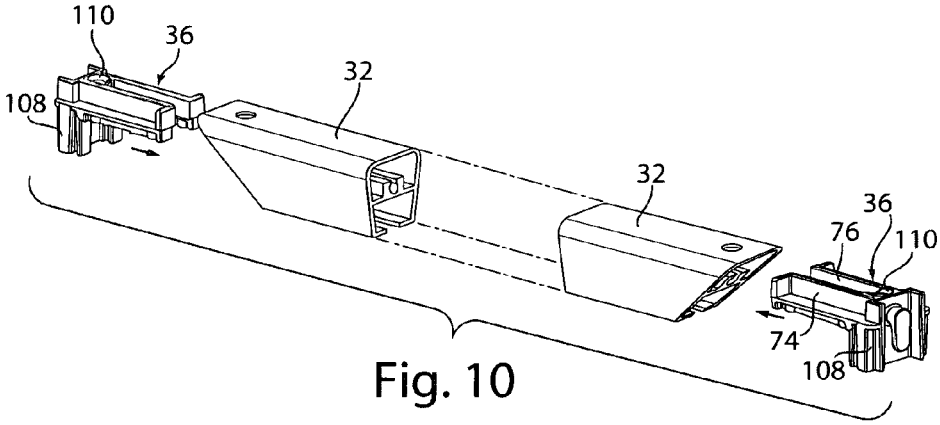
FIG. 10 is an exploded view similar to FIG. 9 showing a unitary rail and its associated corner connectors in a pre-assembled configuration thereof.

An elongated unitary rail 32 may similarly receive a pair of the first and second legs 74 and 76 inserted at each end thereof within their respective leg-receiving channels 58, as represented in FIG. 10. Each leg receiving channel 58 on the elongated unitary rail 32 as noted hereinabove, has a barb engaging surface 60 adjacent its mid-located U-shaped bolt receiving boss 56. The barbs 120 on the underside 118 of the first and second legs 74 and 76 in the bifurcated leg arrangement on the corner connector 36 engage the barb engaging surface 60 in the leg receiving channels 58, so as to snugly support and lockingly secure that corner connector 36 received therein. It has to be noted herein that the length of the third leg 108 extends from the hub 106, preferably no further than the plane "P" (shown in FIGS. 3 and 4) of the first and the second side flanges 64 of the split rails 34 and of the bottom flanges 50 of the unitary rails 32 in which the longer first and the second legs 74 and 76 are inserted. This permits a pre-assembly of a set of corner connectors 36 into a set of elongated split rails 34 and a pre-assembly of an elongated unitary rail 32 with minimum space requirements, to facilitate shipment to and assembly at a commercial location.

Once a set of corner connectors 36 has been inserted into their respective ends of an elongated split rail 34 and an elongated unitary rail 32, a further pair of unitary rails 32 may now receive the third leg 108 of each corner connector 36 which extends from the respective ends of the pre-assembled split rail assembly 34 and the elongated unitary rail 32, so as to provide the third and fourth sides of a frame assembly 30 as represented in FIG. 2 and FIG. 1.

A threaded member such as a screw or a bolt 130 may be inserted through the slot 52 in the outer portions 62 of the split rail 34 and through the bolt hole 110 at the hub of the corner connectors and into the U-shaped boss 56 to secure the pair of split rails 34 to a pair of side unitary rails 32 as represented in FIG. 2. A similar arrangement may be constructed with the remaining unitary rail 32 at the other end of the now-attached side unitary rails 32 by insertion of a bolt 132, as represented in FIG. 2, through a pre-drilled bolt hole 134 at the respective ends of the unitary rail 32 as represented in FIG. 10, and hence through the bolt hole 110 in each corner connector 36 and into a U-shaped bolt receiving boss 56 on the inner bridge member 54 of the respective unitary rail 32 for completion of a four sided frame assembly 30, represented in FIGS. 1 and 2.

Figure 11:
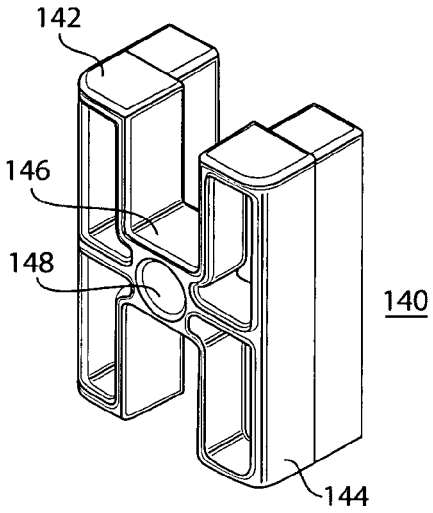
FIG. 11 is a perspective view of an "H" shaped sliding carriage.
Figure 12:
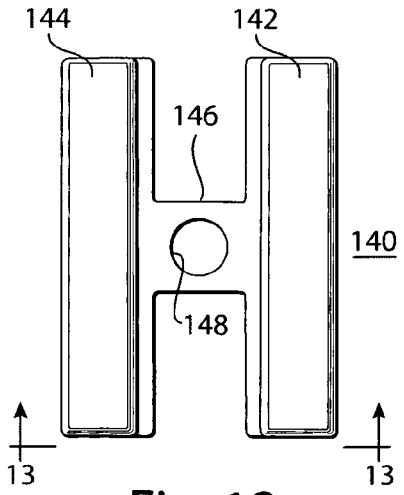
FIG. 12 is a bottom view of the H. shaped sliding carriage shown in FIG. 11.
Figure 13:
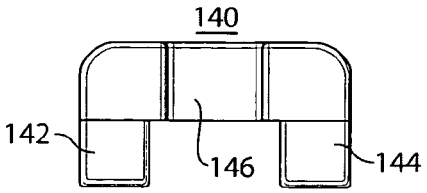
FIG. 13 is a view taken along the lines 13-13 of FIG. 12.
Figure 14:
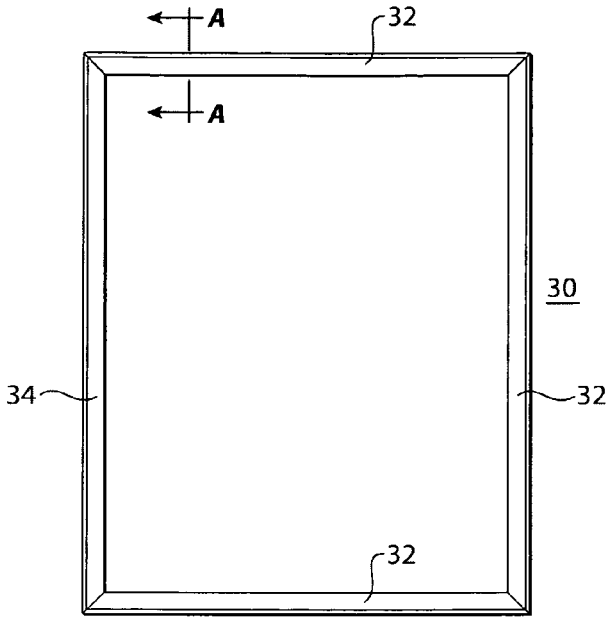
FIG. 14 is a plan view of a frame assembly with a pair of split rails and opposed portions thereof.
Figure 15:
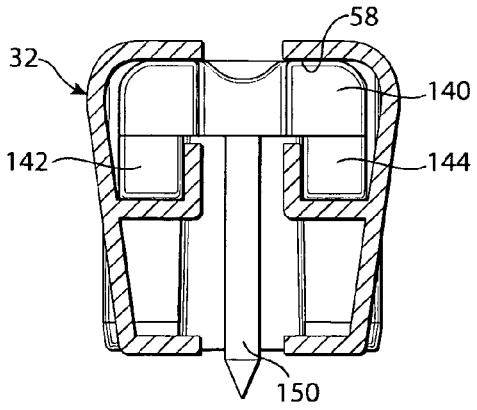
FIG. 15 is a sectional view taken along the lines A-A of FIG. 14.

A further aspect of the present invention includes an "H"-shaped sliding carriage 140, shown in FIGS. 11, 12 and 13. The carriage 140 has a first leg and a second leg 142 and 144 in a parallel, spaced apart configuration, connected by a bridge member 146 extending between a mid-portion thereof. The bridge member 146 includes a mid-portion with a bolt hole 148 therethrough. The sliding carriage 140 may be inserted within the leg receiving channels 72 of a pair of elongated split rails 34 before the corner connectors 36 are inserted respectively therein. The sliding carriage 140 permits an elongated central cross member 92, identified hereinabove, to be supported between a pair of parallel rails, such as an elongated unitary rail 32 and an elongated pair of split rails 34, as represented in FIG. 16. The bolt hole 148 through the bridge member 146 of the sliding carriage 140 is arranged to receive an attachment bolt 150 which extends therethrough, as represented in FIG. 15, which attachment bolt 150 would penetrate and be secured to the elongated slot 104 in each respective end of the elongated central cross member 92, to permit its' extending between a pair of parallel rails 34 and 32, as represented in FIG. 16. The elongated central cross member 92 also has a pair of side channels 111 and 113 to either side of the threaded connector receiving channel 104, as represented in FIG. 5. These serve to receive a pin, not shown for clarity of figures, which pin may be used to prevent rotation when one end of the pin is engaged in a drilled hole in the inner flange 98, 64 or 50 of an abutting cross member 92, split rail 34 or unitary rail 32, respectively. The elongated central cross member 92 would function so as to, for example, subdivide a frame assembly 30 into smaller panel-supporting members, as represented in FIG. 16. Each elongated central cross member 92 also has a pair of elongated panel-receiving slots 52 at respective sides thereof, as represented in FIG. 5, so as to receive and support a display panel "DP" therewithin, in conjunction with the receiving slots 52 on the inner side of a unitary rail 32 or on the inner side of a pair of assembled elongated split rails 34.

The invention claimed is:

1. A multi-sided frame assembly for supporting and displaying a display panel therewithin, the frame assembly comprising:

a first elongated rail having a permanently fixed corner connector inserted into a corner-connector receiving-channel at each end thereof;

a second elongated rail having a permanently fixed corner connector inserted into a corner-connector receiving-channel at each end thereof; and a pair of elongated unitary side rails arranged parallel to each other and perpendicular to the first and second elongated rails, the unitary side rails having a corner connector receiving channel and a fastener receiving channel, to permit a securably reinforced construct of the four sided frame assembly, wherein the corner connector in each end of the first elongated rail has a hub with a channel for the receipt of a fastener to extend therethrough and into the fastener receiving channel of an adjacent respective side rail.

2. The frame assembly as recited in claim 1, wherein the fastener comprises a threaded member.

3. The frame assembly as recited in claim 1, wherein the first elongated rail comprises a joined split rail arrangement.

4. The frame assembly has recited in claim 3, wherein a sliding carriage is arranged within the corner connector receiving channel of the parallel, joined split rails.

5. The frame assembly as recited in claim 1, wherein the corner connector arranged at each end of the elongated first rail has a rail engaging surface with an arrangement of inwardly directed rigid barbs thereon for secure engagement with a corner-connector receiving-channel.

6. The frame assembly as recited in claim 1, wherein the corner connectors at each end of the first and the second rails are secured thereto by one of following: adhesive, elongated fasteners and metal deformation.

7. The frame assembly as recited in claim 1, wherein the second elongated rail is a unitary rail.

8. The frame assembly as recited in claim 7, wherein the elongated first rail has a slot arranged through an outer bridge member thereof, to permit passage of a display panel therethrough and into the frame assembly.

9. The frame assembly as recited in claim 1, wherein the fastener extends in parallel alignment with the adjacent rail to which it is attached.

10. The frame assembly as recited in claim 1, wherein each corner connector has a pair of split legs and a single leg which each extend from a common corner hub.

11. The frame assembly as recited in claim 10, wherein the split legs of each corner connector are longer than the single leg extending from the common corner hub.

12. The frame assembly as recited in claim 10, wherein the corner hub has a support cleat thereon, to permit engagement with an overhead support member.

13. The frame assembly as recited in claim 1, which includes at least one elongated central cross-member adjustably supported between two rails.

14. A method of securely supporting and displaying a display panel within a four sided frame assembly, comprising:

installing a corner connector permanently, into a corner-connector receiving-channel in each end of an elongated first rail;

installing a corner connector permanently, into a corner-connector receiving-channel in each end of an elongated second rail;

assembling the first rail and the second rail with a pair of elongated side rails arranged parallel to each other and perpendicular to the first and second rails, the side rails having a corner connector receiving channel mating with the respective corner connectors in the first rail and the second rail, the side rails each also having a fastener receiving channel, to permit a fastener secured reinforced construct of the four sided frame assembly; and installing a fastener through a fastener receiving channel in a hub of the corner connector in each end of the elongated first rail and into the fastener receiving channel of an adjacent respective side rail.

15. The method as recited in claim 14, wherein the elongated first rail is a split rail.

16. The method as recited in claim 15, wherein the fastener comprises a threaded member.

17. The method as recited in claim 16, wherein the elongated first rail comprises a joined split rail arrangement.

18. The method as recited in claim 17, including:

arranging barbs on a rail engaging surface of the corner connector arranged at each end of the elongated first rail for secure engagement of the corner-connector with the corner connector receiving-channel.

19. The method as recited in claim 18, including:

supporting the frame assembly from an overhead support by attachment of a support member to a cleat arranged on an outer side of the hub of the corner connectors received in the corner connector receiving channels in the elongated first rail.

* * * * *